US005878447A

United States Patent [19]

Mogab et al.

[11] Patent Number: 5,878,447

[45] Date of Patent: Mar. 9, 1999

[54] AUTOMATIC WATER REGULATOR APPARATUS FOR FILLING A SWIMMING POOL OR COMPARABLE BODY OF WATER WHEN THE WATER LEVEL IS LOW

[75] Inventors: Gregory A. Mogab, Reseda; Robert G. Wilcox, Calabasas, both of Calif.

[73] Assignee: WKR Productions, Inc., Van Nuys, Calif.

[21] Appl. No.: 957,600

[22] Filed: Oct. 24, 1997

[51] Int. Cl.[6] ..... E04H 4/00

[52] U.S. Cl. ..... 4/508

[58] Field of Search ..... 4/508

[56] References Cited

U.S. PATENT DOCUMENTS

| | | | |
|---|---|---|---|
| 3,114,243 | 12/1963 | Winters . | |
| 3,537,111 | 11/1970 | Whitten | 4/508 |
| 3,726,477 | 4/1973 | Shapiro . | |
| 4,133,058 | 1/1979 | Baker . | |
| 4,194,691 | 3/1980 | Birnbach et al. . | |
| 4,197,866 | 4/1980 | Neal . | |
| 4,380,091 | 4/1983 | Lively | 4/508 |
| 4,389,739 | 6/1983 | Baker | 4/508 X |
| 4,396,149 | 8/1983 | Hirsch . | |
| 4,607,399 | 8/1986 | Yovanofski . | |
| 4,621,657 | 11/1986 | St. Ledger . | |
| 5,117,855 | 6/1992 | Goldsmith . | |
| 5,730,861 | 3/1998 | Sterghos et al. | 4/508 |

*Primary Examiner*—Charles E. Phillips

*Attorney, Agent, or Firm*—Thomas I. Rozsa; Tony D. Chen; Jerry Fong

[57] ABSTRACT

An automatic water regulator apparatus for automatically filling a swimming pool or comparable body of water when the water level is below a predetermined threshold. The water regulator apparatus can be added to any existing built in swimming pool equipped with a skimmer and a water fill line. The water regulator apparatus automatically senses the water level of the swimming pool, establishes if the level is within the allowable range, causes the pool water fill line to turn on if below the allowable range, and subsequently shuts off when the desired water level has been reached. The water regulator apparatus comprises a transmitter assembly and a receiver assembly. The transmitter assembly includes a water level detector which periodically automatically monitors the water level within the pool. If the water level is below a specified threshold, the transmitter assembly sends a radio transmission to be received by the receiver assembly. When the receiver assembly receives the radio transmission, it causes a water fill valve to automatically turn on a water supply to the pool, thereby filling the swimming pool. As the swimming pool is filling, the water level detector monitors the water level until the water level has reached a specified threshold. Once the specified threshold has been reached, the transmitter assembly sends a radio transmission to be received by the receiving assembly. When the receiving assembly receives the radio transmission, it causes the water fill valve to automatically turn off the water supply to the pool.

18 Claims, 3 Drawing Sheets

AUTOMATIC WATER REGULATOR APPARATUS FOR FILLING A SWIMMING POOL OR COMPARABLE BODY OF WATER WHEN THE WATER LEVEL IS LOW

BACKGROUND OF THE INVENTION

1. Field of the Invention

The present invention generally relates to the field of swimming pools. More particularly, the present invention relates to the field of automatically activating and deactivating a water supply when the water level in a swimming pool or other body of water is low or high.

2. Description of the Prior Art

Specifically, one of the most common responsibilities associated with pool maintenance is maintaining the proper water level in the swimming pool. Pool water level may fall below acceptable levels due to many factors including evaporation, splashing action, and leakage. If the pool water is too low, the filter will not work properly and may cause damage to the filter which can be costly to repair. In addition, if the swimming pool water is too low, the pool water will not get filtered resulting in stagnation, the pool's sidewall plaster may become stained, and the pool's tile grout may become damaged.

Depending on the swimming pool size, geographical location, time of year (e.g. summer or winter), exposure to sunlight, and amount of use and splashing, a swimming pool may require adding water as much as three times a week, for approximately twenty to thirty minutes per time.

To solve the dilemma of having a water level too low in a swimming pool, pool owners are required to manually turn on the water fill valve to fill the pool, and must subsequently manually turn off the water fill valve once the pool has been adequately filled. The disadvantage of manually turning off the water to the pool is that human presence and labor are required. As a result, pool owners may not be able to take a vacation, since human presence is required to manually add water to the swimming pool. Another disadvantage of manually turning on and subsequently turn off the water to the pool is that the individual may forget to subsequently turn off the pool water once the pool has been adequately filled resulting in the pool being overfilled or overflowing, thereby wasting water.

The following nine (9) prior art patents are found to be pertinent to the field of the present invention:

1. U.S. Pat. No. 3,114,243 issued to Winters on Dec. 17, 1963 for "Automatic System Of Agricultural Irrigation" (hereafter the "Winters Patent");
2. U.S. Pat. No. 3,726,477 issued to Shapiro on Apr. 10, 1973 for "Automated Irrigation System" (hereafter the "Shapiro Patent");
3. U.S. Pat. No. 4,133,058 issued to Baker on Jan. 9, 1979 for "Automated Pool Level And Skimming Gutter Flow Control System" (hereafter the "Baker Patent");
4. U.S. Pat. No. 4,194,691 issued to Birnbach et al on Mar. 25, 1980 for "Automatic Control Of The Moisture Content Of The Soil" (hereafter the "Birnbach Patent");
5. U.S. Pat. No. 4,197,866 issued to Neal on Apr. 15, 1980 for "Soil Moisture Sampler And Controller" (hereafter the "Neal Patent");
6. U.S. Pat. No. 4,396,149 issued to Hirsch on Aug. 2, 1983 for "Irrigation Control System" (hereafter the "Hirsch Patent");
7. U.S. Pat. No. 4,607,399 issued to Yovanofski on Aug. 26, 1986 for "Automatic Pool Water Regulator Apparatus" (hereafter the "Yovanofski Patent");

8. U.S. Pat. No. 4,621,657 issued to St. Ledger on Nov. 11, 1986 for "Automatic Water Level Monitoring System" (hereafter the "St. Ledger Patent"); and
9. U.S. Pat. No. 5,117,855 issued to Goldsmith on Jun. 2, 1992 for "Automatic Water Control Apparatus" (hereafter the "Goldsmith Patent").

The Shapiro Patent discloses an automatic irrigation system wherein the valves are remotely opened by means of radio signals for operating various irrigation sprinkler valves.

The Baker Patent discloses an automatic pool level and skimming gutter flow control system. It comprises sensor means for sensing the changes in water level and water activity and actuating appropriate mechanical response mechanisms for controlling water feed and skimming gutter drain flow. The system is generally built into the swimming pool upon construction of the pool, or would require substantial installation and expense to add to an existing pool not equipped with the system as it is built into the sidewall, plaster and cement decking of the pool.

The Birnbach Patent discloses an automatic control of the moisture content of the soil. The moisture content of the soil is maintained between predetermined wet and dry thresholds by a control in response to detected thresholds through contacts inserted in the soil to effect the opening and closing of a valve in the conduit by which water is delivered to that area.

The Hirsch Patent discloses an irrigation control system. It comprises masts, soil measurement sensors associated with a lower portion of each mast, data transmission apparatus associated with an upper portion of each mast to transmit data continuously measured by the sensor, and a processing device to process that transmitted data.

The Yovanofski Patent discloses an automatic pool water regulator apparatus. It comprises a pipe opening into the pool through the sidewall and plaster of the pool adequately below the minimum allowable water level of the pool, extending horizontally to supply pool water to two vertical pipes situated away from the swimming pool and which indicate the pool water level. Each pipe has a floating element disposed therein. Each float element has a switch secured to a distal end protruding from the vertical pipes. Brackets are mounted adjacent the switches so that as the float elements rise and fall, the switches are turned ON and OFF thereby activating either pool draining or pool filling devices. The system is generally built into the swimming pool upon construction of the pool or would require substantial installation and expense to add to an existing pool not equipped with the system as it is built into the sidewall, plaster and possibly the cement decking of the pool.

The St. Ledger Patent discloses an automatic water level monitoring system for maintaining a preselected water level. It comprises a chamber in communication with the pool such that the water level in the chamber corresponds to that of the pool. The chamber contains an adjustable overflow tube and a vertically oriented water supply line which has a mechanical diaphragm valve and surrounded by an annular float, where the valve is actuated by a height adjustable overhead actuator bar. The system is generally built into the swimming pool upon construction of the pool or would require substantial installation and expense to add to an existing pool not equipped with the system as it is built into the sidewall, plaster and cement decking of the pool.

The Goldsmith Patent discloses an automatic water control apparatus with a venturi to control water flow over a waterfall. The venturi has a bypass conduit so that the venturi does not act to limit the flow of water to demands made downstream of the water control system. It further comprises a light sensitive control to allow water flow only during day or night by controlling the transmission of the vacuum pulled by the venturi to a porous moisture sensor.

The Winters Patent discloses an automatic system for controlling water on agricultural land.

The Neal Patent discloses a soil moisture sampler and controller. It automatically activates in-ground probes to measure the soil moisture.

It is highly desirable to have a very efficient and also very effective design and construction of an automatic water regulator apparatus for automatically activating a water supply to fill a swimming pool or the like when the water level reaches a certain minimum threshold and deactivating the water supply when the water level reaches a certain maximum threshold. It is desirable that the system does not require installation upon construction of the swimming pool or substantial installation and expense on existing swimming pools. It is also desirable that the system can be easily, efficiently and inexpensively installed by the pool owner to any swimming pool equipped with a water fill line.

SUMMARY OF THE INVENTION

The present invention is an automatic water regulator apparatus for automatically filling swimming pools or comparable body of water when the water level is below a predetermined threshold. The water regulator apparatus can be added to any existing built in swimming pool equipped with a skimmer and a water fill line. The water regulator apparatus automatically senses the water level of the swimming pool, establishes if the level is within the allowable range, causes the pool water fill line to turn on if below the allowable range, and subsequently shuts off when the desired water level has been reached.

The water regulator apparatus comprises a transmitting assembly and a receiving assembly. The transmitting assembly includes a water level detector which periodically automatically monitors the water level within the pool. If the water level is below a specified lower threshold, the transmitting assembly sends a radio transmission to be received by the receiving assembly. When the receiving assembly receives the radio transmission, it causes a water fill valve to automatically turn on a water supply to the pool, thereby filling the swimming pool. As the swimming pool is filling, the water level detector monitors the water level until the water level has reached a specified threshold. Once the specified threshold has been reached, the transmitting assembly sends a radio transmission to be received by the receiving assembly. When the receiving assembly receives the radio transmission, it causes the water fill valve to automatically turn off the water supply to the pool.

It is therefore an object of the present invention to provide an automatic water regulator apparatus which is easily and inexpensively installed by the pool owner onto any existing swimming pool equipped with a water fill line or is easily and inexpensively installed upon construction of the swimming pool.

It is an additional object of the present invention to provide an automatic water regulator apparatus which can be placed within an existing swimming pool's skimmer cover.

It is a further object of the present invention to provide an automatic water regulator apparatus for automatically maintaining the water level of a swimming pool, so that when the water level of the swimming pool is below a predetermined threshold, the apparatus causes a water fill valve to automatically turn on a water supply to the pool, thereby filling the swimming pool to a predetermined water level height.

It is another object of the present invention to provide a daytime or nighttime sensor control for the automatic water regulator apparatus that allows the apparatus to operate during the day or during the night.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
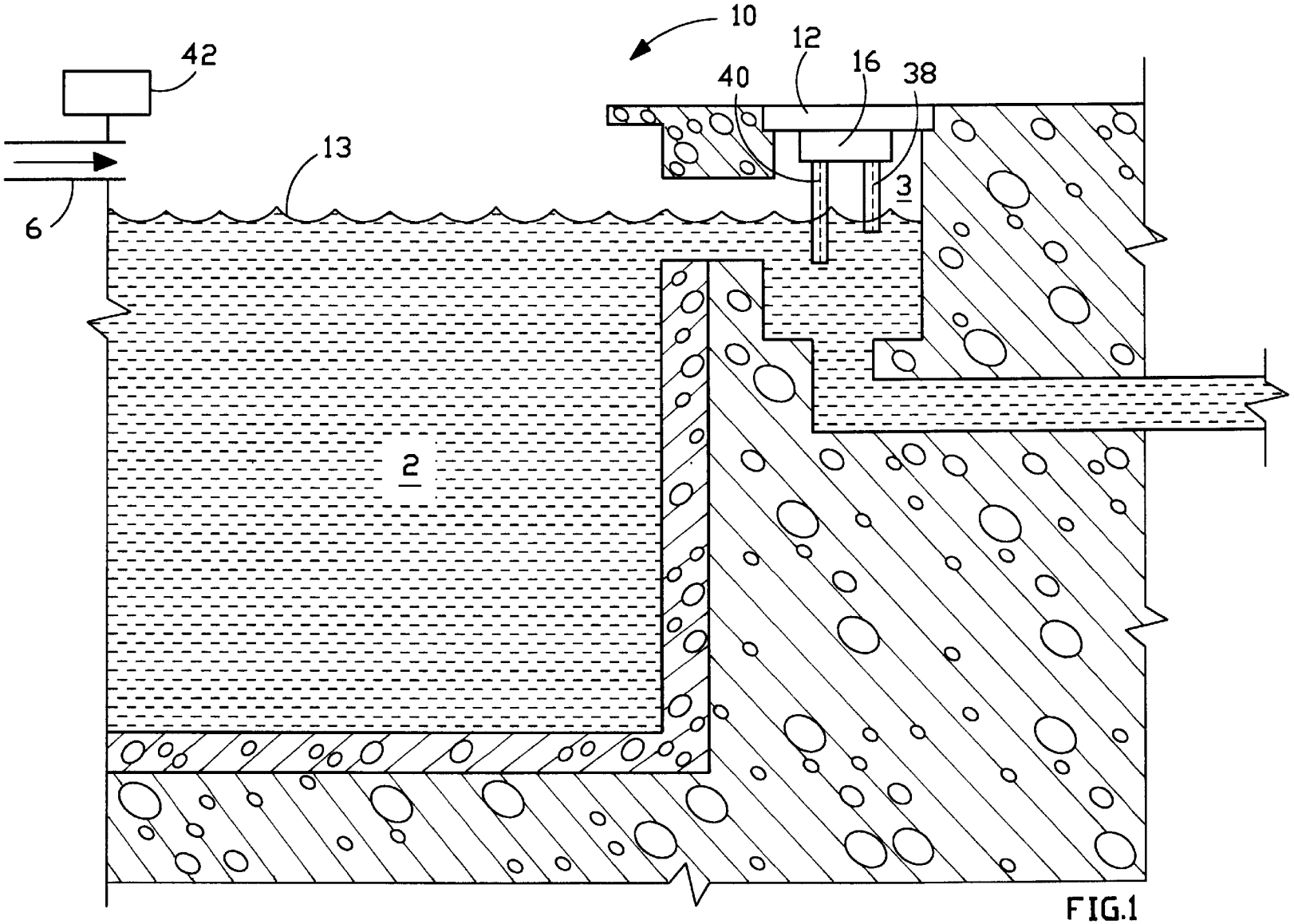
FIG. 1 is an illustration of the present invention automatic water regulator apparatus used in conjunction with a swimming pool.

Referring to FIG. 1, there is depicted at 10 the present invention automatic water regulator apparatus which is used in conjunction with a swimming pool 2. The automatic water regulator apparatus 10 can be added to any existing built-in swimming pool 2 equipped with a skimmer 3 having a top opening. A water supply with a water supply line or pipe 6 is connected to the swimming pool 2 for supplying water. The automatic water regulator apparatus 10 is used for automatically activating the water supply to fill the swimming pool 2 when the water level 13 in the pool 2 is below a predetermined low water level and deactivating the water supply when the water level 13 in the pool 2 reaches a certain predetermined water level height. The apparatus 10 automatically senses the water level 13 of the swimming pool 2, establishes if the level is within the allowable range, causes the water supply to turn on if below the allowable range, and subsequently shut off when the desired water level has been reached.

Figure 2:
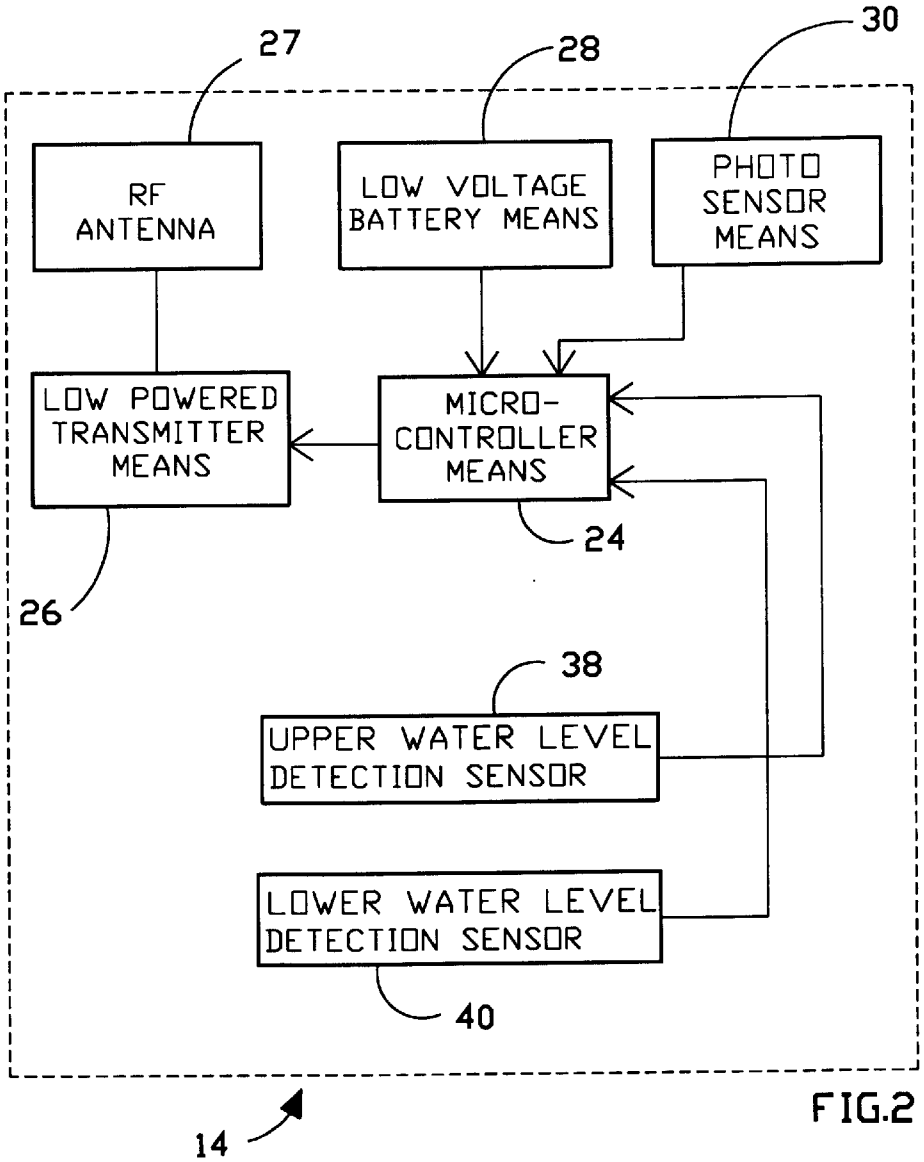
FIG. 2 is a simplified block diagram of a transmitting assembly of the present invention automatic water regulator apparatus.
Figure 3:
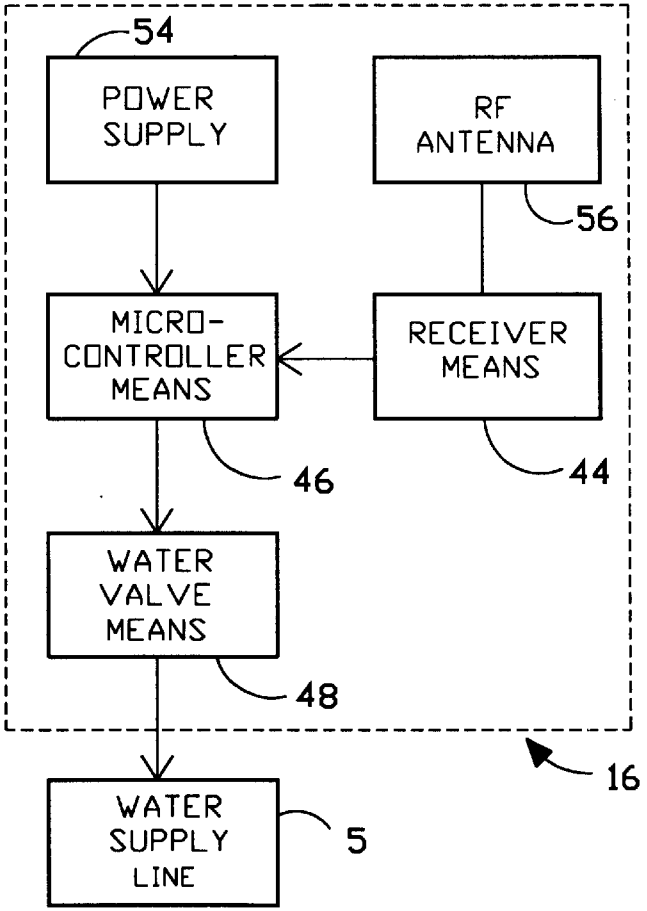
FIG. 3 is a simplified block diagram of a receiving assembly of the present invention automatic water regulator apparatus.

Referring to FIGS. 1, 2 and 3, the automatic water regulator apparatus 10 comprises a skimmer cover 12, a transmitting assembly 14 and a receiving assembly 16. The skimmer cover 12 is shaped and sized to fit over an opening of the skimmer 3. It will be appreciated that the skimmer cover 12 may be any shape, for example, circular, square, rectangular or etc., to fit over the opening of a pool's skimmer 3.

Referring to FIGS. 1 and 2, the transmitting assembly 14 is housed in a first self-contained housing 16 which is impervious to water. The first self-contained housing 16 is directly attached underneath the skimmer cover 12. The transmitting assembly 14 includes a low voltage battery means 28, a transmitting micro-controller 24, a digitally coded transmitter 26, a radio frequency (RF) antenna 27 coupled to the transmitter 26, an upper water level detection sensor 38, and a lower water level detection sensor 40. A power means which can be a low voltage battery power supply 28 supplies the power necessary to operate the micro-controller 24, the digitally coded transmitter 26, and the upper 38 and lower 40 water level sensors. The micro-controller 24 is operatively connected to the low voltage power supply 28, the digitally coded transmitter 26, and the upper and lower sensors 38 and 40. The micro-controller 24 may be a PIC12C508 made by Microchip, Phoenix Ariz. or it may be any other suitable control means. The micro-controller 24 further has means for power management and means for gathering the water level data, evaluating data such as splashing or water level changes, and configuring data for transmission.

A photo sensor means 30 is provided with the present invention automatic water regulator apparatus 10 and is also housed within the first self-contained housing 16. The photo sensor means 30 allows the apparatus to sense day or night, thereby allowing the apparatus to operate either during the day or during the night, as selected by a user.

The upper level sensor 38 is adjustably mounted on and extends downwardly from the self-contained housing 16 for detecting a predetermined high water level of the swimming pool 2. The lower level sensor 40 is adjustably mounted on and extends downwardly from the self-contained housing 16 for detecting a predetermined low water level and located remote from the upper level sensor 38. The upper level sensor 38 and lower level sensor 40 function together to provide a closed circuit in the transmitting circuit assembly whenever the water level in the pool is normal or in operating range. Once the circuit is open, the water level falls below the lower level sensor 40 which detects the lower water level and activates the transmitting micro-controller 24 which in turn commands the transmitter 26 to transmit a low water level signal. The transmitter 26 is activated by the transmitting micro-controller 24 which in turn is activated by the lower level sensor 40 and periodically sends the lower water level signal at time intervals until the upper level sensor 38 detects the high water level at which time the periodic transmission from the transmitter 26 is terminated. The upper level sensor 38 and lower level sensor 40 are user adjustable, thereby allowing the pool owner to adjust the minimum acceptable lower level sensor 40 and the maximum acceptable upper level sensor 38 to the specifications of the specific pool. It will be appreciated that the lower level sensor 40 may consist of a pair of spaced apart elongated stainless steel rods which extend into the water within the skimmer 3 to register the low water level reading and the upper level sensor 38 may also consist of a pair of spaced apart elongated stainless steel rods which also extend into the water within the skimmer 3 to register the high water level reading. The rods at the upper level sensor 38 will be shorter than the rods of the lower level sensor 40, thereby providing an operating range of when the water level is low or high.

Referring to FIGS. 1 and 3, the receiving assembly 16 is housed within a second self-contained housing 42 which is impervious to water. The second self-contained housing 42 is adapted to be mounted in-line with the water supply line 6. The receiving assembly 16 includes a digitally coded receiver 44, a radio frequency (RF) antenna 56 coupled to the digitally coded receiver 44, a receiving micro-controller 46, a water fill valve means 48, and a power supply 54. The digitally coded receiver 44 is operatively coupled to the micro-controller 46 for receiving the output signals from the transmitter 26. When the digitally coded receiver 44 receives the low water level signal from the transmitter 26, it sends a signal to the receiving micro-controller 46 which in turn commands the water fill valve means 48 to open, thereby allowing water flow to the pool 2. The receiving micro-controller 46 causes the water fill valve 48 to be deactivated when the periodic transmitted low water level signal from the transmitter 26 to the receiver 44 is terminated. The receiving micro-controller 46 further has means for automatically alarming the system with an audible or light indicator in the event of a failed transmission, and also has means for automatically shutting off the water supply in the event of a failed transmission. The water fill valve means 48 has an open position and a closed position for controlling the flow of water through itself. The water fill valve means 48 has an input water connection for connecting to the water supply line 6 and an output water connection for supplying water to the pool 2.

The power supply 54 is used for supplying electrical power to the receiving assembly 16. The power supply 54 may be a low voltage alternating current (AC) power source or a battery means.

Referring to FIGS. 1, 2 and 3, the operation of the foregoing embodiment now will be described. The water regulator apparatus automatically and periodically monitors the water level within the pool 2. If the water level 13 is below a specified lower threshold, the transmitter 26 sends a radio transmission to be received by the receiver 44. When the receiver 44 receives the radio transmission transmitted from the transmitter 26, it sends a signal to the receiving micro-controller 46 which in turn causes the water fill valve means 48 to automatically turn on the water supply to the pool 2, thereby filling the swimming pool 2. As the swimming pool is filling, the transmitting assembly 16 monitors the water level in the pool. Once the water level has reached a specified upper level, the transmitter 26 stops sending the low water level radio transmission to the receiver 44 which in turn stops sending its own signal to the receiving micro-controller 46 which in turn deactivates the water fill valve 48 to automatically turn off the water supply line to the pool.

The present invention conforms to conventional forms of manufacture or any other conventional way known to one skilled in the art, and is of simple construction and is easy to use.

Figure 4:
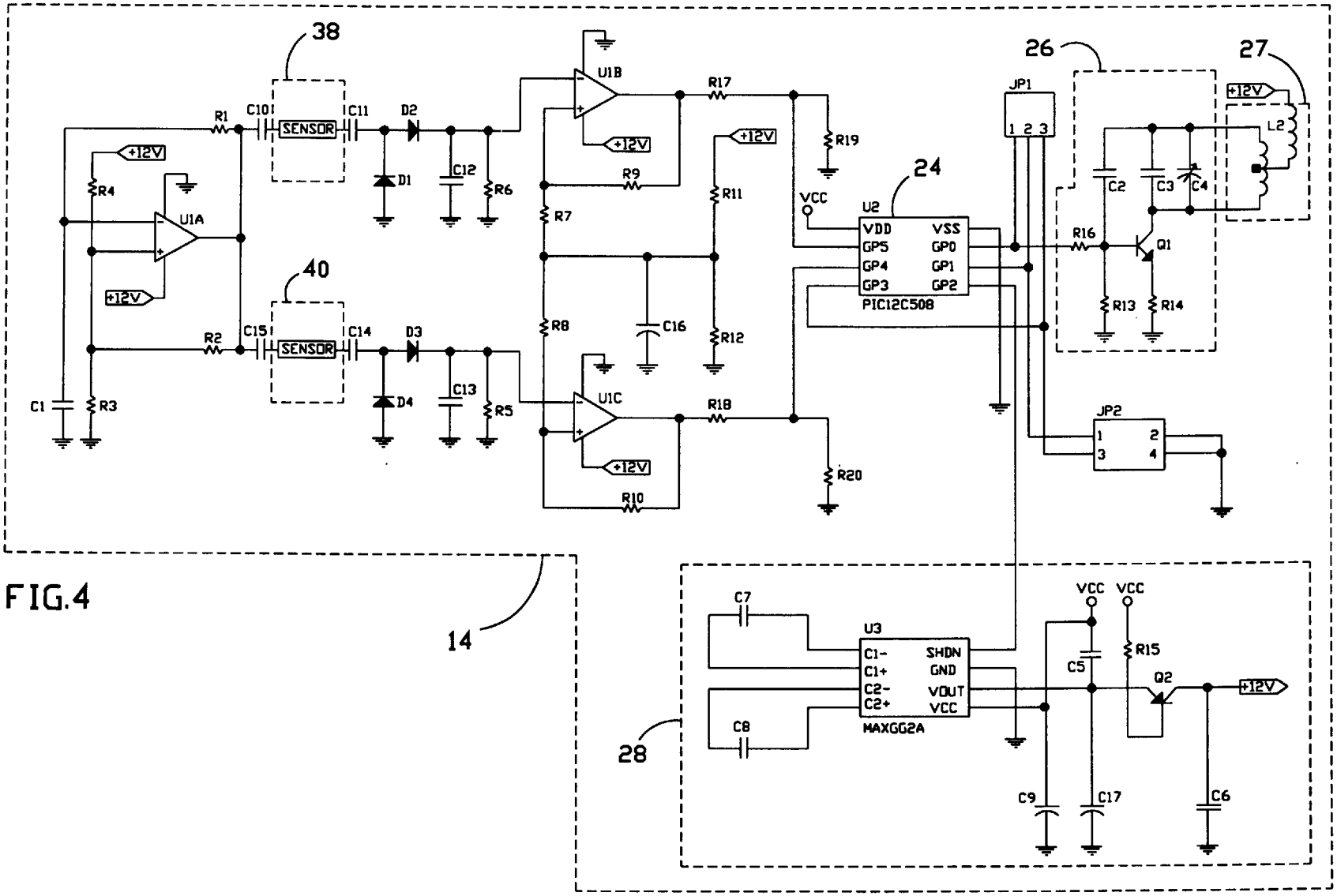
FIG. 4 is a preferred embodiment of a schematic diagram of the transmitting assembly shown in FIG. 2.

Referring to FIG. 4, there is shown a schematic diagram of the preferred embodiment of the transmitting assembly 14 of the present invention water regulator apparatus. It will be appreciated that the transmitting assembly 14 is not limited to circuitry shown in FIG. 4. It is emphasized that while the circuitry shown in FIG. 4 is the preferred embodiment, it is also within the spirit and scope of the present invention to have many circuit variations which are known to one skilled in the art.

For convenience in comparing FIG. 4 with FIG. 2, various circuits have been outlined on FIG. 4 to show the preferred equivalents to the low voltage battery means 28, the transmitting micro-controller 24, the digitally coded transmitter 26, the radio frequency (RF) antenna 27, the upper water level detection sensor 38, and the low water level detection sensor 40 of the transmitting assembly 16. By way of example only, R1, R2, R3, R4, R8, R11, R12, R19, and R20 are 47 KΩ resistors; R5 and R6 are 1 MΩ resistors; R7 is 680 Ω resistor; R9 and R10 are 68 KΩ resistors; R13, R17 and R18 are 100 KΩ resistors; R14 is 100 Ω resistor; R15 is 39 KΩ resistor; R16 is 10 KΩ resistors; C1 is 0.022 μF mylar capacitor; C2 and C3 are 2 ρF capacitors; C4 is 1.5–5 ρF variable capacitor; C5, C6, C10, C11, C12, C13, C14, and C15 are 0.1 μF capacitors; C7 and C8 are 0.22 μF capacitors; C9 and C17 are 4.7 μF capacitors; C16 is 10 μF capacitor; L2 is 10 μH; D1, D2, D3, and D4 are 1N4148 diodes; Q1 is BF199 transistor; Q2 is PN2907 transistor; JP1 and JP2 are jumpers; U1A, U1B and U1C are type LM324 comparators; U2 is PIC12C508 integrated circuit; and U3 is MAX662A integrated circuit.

Defined in detail, the present invention is an automatic water regulator apparatus for automatically maintaining a water level in a swimming pool or comparable body of water and used in conjunction with a skimmer having an opening, the apparatus comprising: (a) a skimmer cover being sized to fit over the opening of the skimmer; (b) a transmitting assembly housed within a first self-contained housing and including a transmitter, a transmitting micro-controller, a lower sensor, an upper sensor, and a power means, the self-contained housing attached to a bottom of the skimmer cover, (i) the transmitter operatively coupled to the transmitting micro-controller which in turn operatively coupled to the upper and lower sensors, (ii) the lower sensor adjustably mounted on and extending downwardly from the self-contained housing for detecting a predetermined low water level of the swimming pool or comparable body of water and activating the transmitting micro-controller which in turn commands the transmitter to transmit a low water level signal, (iii) the upper sensor adjustably mounted on and located remotely from the lower sensor and extending downwardly from the self-contained housing for detecting a predetermined high water level of the swimming pool or comparable body of water, (iv) the transmitter activated by the transmitting micro-controller which in turn is activated by the lower sensor periodically sending the low water level signal at time intervals until the upper sensor detects the high water level at which time periodic transmission from the transmitter is terminated, (v) the power means supplying electrical power to the transmitting assembly; (c) a receiving assembly housed within a second self-contained housing and including a receiver, a receiving micro-controller, a water fill valve, and a power supply, the second self-contained housing being mounted on a water supply line, (i) the receiver operatively coupled to the receiving micro-controller which in turn is operatively coupled to the water fill valve, (ii) the receiver receiving the low water level signal which in turn sends the low water level signal to the receiving micro-controller which in turn activates the water fill valve to supply water to the swimming pool or comparable body of water, the receiving micro-controller causing the water fill valve to be deactivated when the periodic transmitted low water level signal is terminated, and (iii) the power supply supplying power to the receiving assembly; (d) whereby the water level of the swimming pool or comparable body of water is constantly maintained between the predetermined high and low water levels by the automatic water regulator apparatus.

Defined broadly, the present invention is a water regulator apparatus for automatically maintaining a water level in a pool or comparable body of water and used in conjunction with a skimmer having an opening, the apparatus comprising: (a) a transmitting assembly housed within a first self-contained housing and including a transmitter, a first controller, a lower sensor, an upper sensor, and power means for supplying power to the transmitting assembly, (i) the transmitter operatively coupled to the transmitting micro-controller which in turn is operatively coupled to the upper and lower sensors, (ii) the lower sensor extending downwardly from the self-contained housing for detecting a predetermined low water level of the swimming pool or comparable body of water and activating the first controller which in turn commands the transmitter to transmit a low water level signal, (iii) the upper sensor extending downwardly from the self-contained housing for detecting a predetermined high water level of the swimming pool or comparable body of water, (iv) the transmitter activated by the first controller which in turn is activated by the lower sensor periodically sending the low water level signal at time intervals until the upper sensor detects the high water level at which time periodic transmission from the transmitter is terminated; (b) a receiving assembly housed within a second self-contained housing and including a receiver, a second controller, a water fill valve, and a power supply for supplying power to the receiving assembly, the second self-contained housing being mounted to a water supply line, (i) the receiver operatively coupled to the second controller which in turn is operatively coupled to the water fill valve, and (ii) the receiver receiving the low water level signal which in turn sends the low water level signal to the second controller which in turn activates the water fill valve to supply water to the swimming pool or comparable body of water, the second controller causing the water fill valve to be deactivated when the periodic transmitted low water level signal is terminated; (c) whereby the water level of the swimming pool or comparable body of water is constantly maintained between the predetermined high and low water levels by the water regulator apparatus.

Defined more broadly, the present invention is an apparatus for automatically maintaining a water level in a pool or comparable body of water, the apparatus comprising: (a) a first sensing means for detecting a low water level in the pool and causing a transmitter means to transmit a low water level signal; (b) a second sensing means for detecting a high water level; (c) the transmitter means activated by the first sensing means periodically sending the low water level signal at time intervals until the second sensing means detects a high water level at which time periodic transmission from the transmitter means is terminated; and (d) a control means for receiving the transmitted low water level signal which in turn activates a water fill valve to supply water to the pool, the control means causing the water fill valve to be deactivated when the periodic transmitted low water level signal is terminated.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An automatic water regulator apparatus for automatically maintaining a water level in a swimming pool or comparable body of water and used in conjunction with a skimmer having an opening, the apparatus comprising:

a. a skimmer cover being sized to fit over the opening of said skimmer;

b. a transmitting assembly housed within a first self-contained housing and including a transmitter, a transmitting micro-controller, a lower sensor, an upper sensor, and a power means, the self-contained housing attached to a bottom of said skimmer cover, (i) said transmitter operatively coupled to said transmitting micro-controller which in turn is operatively coupled to said upper and lower sensors, (ii) said lower sensor adjustably mounted on and extending downwardly from said self-contained housing for detecting a predetermined low water level of the swimming pool or comparable body of water and activating said transmitting micro-controller which in turn commands said transmitter to transmit a low water level signal, (iii) said upper sensor adjustably mounted on and located remotely from said lower sensor and extending downwardly from said self-contained housing for detecting a predetermined high water level of the swimming pool or comparable body of water, (iv) said transmitter activated by said transmitting micro-controller which in turn is activated by said lower sensor periodically sending said low water level signal at time intervals until said upper sensor detects said high water level at which time periodic transmission from said transmitter is terminated, (v) said power means supplying electrical power to said transmitting assembly;

c. a receiving assembly housed within a second self-contained housing and including a receiver, a receiving micro-controller, a water fill valve, and a power supply, the second self-contained housing being mounted on a water supply line, (i) said receiver operatively coupled to said receiving micro-controller which in turn is operatively coupled to said water fill valve, (ii) said receiver receiving said low water level signal which in turn sends said low water level signal to said receiving micro-controller which in turn activates said water fill valve to supply water to said swimming pool or comparable body of water, said receiving micro-controller causing the water fill valve to be deactivated when the periodic transmitted low water level signal is terminated, and (iii) said power supply supplying power to said receiving assembly;

d. whereby the water level of the swimming pool or comparable body of water is constantly maintained between said predetermined high and low water levels by said automatic water regulator apparatus.

2. The apparatus in accordance with claim 1 further comprising a photo sensor housed within said first self-contained for determining daytime or nighttime.

3. The apparatus in accordance with claim 1 wherein said power supply includes a low voltage alternating current (AC) power source.

4. The apparatus in accordance with claim 1 wherein said power supply includes a battery means.

5. The apparatus in accordance with claim 1 wherein said power means includes a low voltage battery means.

6. The apparatus in accordance with claim 1 wherein said lower sensor includes a pair of elongated lower spaced apart probes.

7. The apparatus in accordance with claim 6 wherein said upper sensor includes a pair of upper spaced apart probes shorter than said lower spaced apart probes, wherein the minerals in the water connects the lower and upper sensors for making a closed circuit.

8. A water regulator apparatus for automatically maintaining a water level in a pool or comparable body of water and used in conjunction with a skimmer having an opening, the apparatus comprising:

a. a skimmer cover being sized to fit over the opening of said skimmer b. a transmitting assembly housed within a first self-contained housing and including a transmitter, a first controller, a lower sensor, an upper sensor, and power means for supplying power to the transmitting assembly, said first self-contained housing being attached to a bottom of said skimmer cover (i) said transmitter operatively coupled to said transmitting micro-controller which in turn is operatively coupled to said upper and lower sensors, (ii) said lower sensor extending downwardly from said self-contained housing for detecting a predetermined low water level of the swimming pool or comparable body of water and activating said first controller which in turn commands said transmitter to transmit a low water level signal, (iii) said upper sensor extending downwardly from said self-contained housing for detecting a predetermined high water level of the swimming pool or comparable body of water, (iv) said transmitter activated by said first controller which in turn is activated by said lower sensor periodically sending said low water level signal at time intervals until said upper sensor detects said high water level at which time periodic transmission from said transmitter is terminated;

c. a receiving assembly housed within a second self-contained housing and including a receiver, a second controller, a water fill valve, and a power supply for supplying power to the receiving assembly, the second self-contained housing being mounted to a water supply line, (i) said receiver operatively coupled to said second controller which in turn is operatively coupled to said water fill valve, and (ii) said receiver receiving said low water level signal which in turn sends said low water level signal to said second controller which in turn activates said water fill valve to supply water to said swimming pool or comparable body of water, said second controller causing said water fill valve to be deactivated when the periodic transmitted low water level signal is terminated;

d. whereby the water level of the swimming pool or comparable body of water is constantly maintained between said predetermined high and low water levels by said water regulator apparatus.

9. The apparatus in accordance with claim 8 further comprising a skimmer cover for covering an opening of said skimmer of said pool or comparable body of water.

10. The apparatus in accordance with claim 9 wherein said first self-contained housing is attached to a bottom of said skimmer cover.

11. The apparatus in accordance with claim 8 further comprising a photo sensor housed within said first self-contained housing for determining daytime or nighttime.

12. The apparatus in accordance with claim 8 wherein said lower sensor includes a pair of elongated lower spaced apart probes.

13. The apparatus in accordance with claim 12 wherein said upper sensor includes a pair of upper spaced apart probes shorter than said lower spaced apart probes, wherein the minerals in the water connects the lower and upper sensors for making a closed circuit.

14. An apparatus for automatically maintaining a water level in a pool or comparable body of water and used in conjunction with a skimmer having an opening, the apparatus comprising:

a. a skimmer cover being sized to fit over the opening of said skimmer;

b. a transmitting assembly housed within a self-contained housing and including a transmitter, first sensing means, second sensing means, the self-contained housing being attached to the bottom of said skimmer cover, c. a first sensing means for detecting a low water level in said pool and causing a transmitter means to transmit a low water level signal;

d. a second sensing means for detecting a high water level;

e. said transmitter means activated by said first sensing means periodically sending said low water level signal at time intervals until said second sensing means detects a high water level at which time periodic transmission from said transmitter means is terminated; and f. a control means for receiving said transmitted low water level signal which in turn activates a water fill valve to supply water to said pool, the control means causing the water fill valve to be deactivated when the periodic transmitted low water level signal is terminated.

15. The apparatus in accordance with claim 14 further comprising means for supplying power to said apparatus.

16. The apparatus in accordance with claim 14 further comprising a photo sensor for determining daytime or nighttime.

17. The apparatus in accordance with claim 14 wherein said first sensor means includes a pair of lower spaced apart probes.

18. The apparatus in accordance with claim 17 wherein said second sensor means includes a pair of upper spaced apart probes shorter than said lower spaced apart probes, wherein the minerals in the water connects said first and second sensor means for making a closed circuit.

* * * * *